US007592555B2

(12) United States Patent
Montante et al.

(10) Patent No.: US 7,592,555 B2
(45) Date of Patent: Sep. 22, 2009

(54) RETENTION ARRANGEMENT FOR A CIRCUIT INTERRUPTER

(75) Inventors: Jorge R. Montante, Cicero, IL (US); Michael G. Ennis, Evanston, IL (US); Mark W. Stavnes, Mount Prospect, IL (US)

(73) Assignee: S&C Electric Company, Chicago, IL (US)

( * ) Notice: Subject to any disclaimer, the term of this patent is extended or adjusted under 35 U.S.C. 154(b) by 294 days.

(21) Appl. No.: 11/643,182

(22) Filed: Dec. 21, 2006

(65) Prior Publication Data

US 2007/0210891 A1 Sep. 13, 2007

Related U.S. Application Data

(60) Provisional application No. 60/755,943, filed on Jan. 3, 2006.

(51) Int. Cl.
*H01H 9/20* (2006.01)

(52) U.S. Cl. ..... 200/50.01; 335/167; 337/174

(58) Field of Classification Search ..... 200/48 R, 200/50.01, 50.02, 50.07, 318; 335/167–176, 335/8–10, 202; 337/168–180
See application file for complete search history.

(56) References Cited

U.S. PATENT DOCUMENTS

| | | | | | |
|---|---|---|---|---|---|
| 4,123,639 | A | * | 10/1978 | Evans | 200/254 |
| 4,268,811 | A | * | 5/1981 | Evans et al. | 218/156 |
| 4,542,363 | A | * | 9/1985 | Kato et al. | 337/31 |
| 4,546,341 | A | * | 10/1985 | McNaghten et al. | 337/177 |
| 4,687,277 | A | * | 8/1987 | Biller | 439/620.26 |
| 6,867,679 | B2 | * | 3/2005 | Montante | 337/174 |

* cited by examiner

*Primary Examiner*—Elvin G Enad
*Assistant Examiner*—Marina Fishman

(57) ABSTRACT

A retention arrangement for a circuit interrupter to ensure that ensures the retention of the circuit interrupter in its mounting. The retention arrangement cooperates with a latch member of the mounting for the circuit interrupter. Accordingly, the circuit interrupter is retained in its mounting even where the dimensions of the circuit interrupter may vary from the nominal specified dimensions.

5 Claims, 5 Drawing Sheets

RETENTION ARRANGEMENT FOR A CIRCUIT INTERRUPTER

This application claims the benefit of U.S. Provisional Application No. 60/755,943 filed Jan. 3, 2006.

BACKGROUND OF THE INVENTION

1. Field of the Invention

The present invention relates generally to the field of circuit interrupters for electrical power transmission and distribution and more particularly to a retention arrangement for a circuit interrupter that ensures the retention of the circuit interrupter in its mounting.

2. Description of the Related Art

Many types of circuit interrupting devices in the electrical power distribution and transmission field are installed in mountings so as to be selectively removable from the mountings. For example, various types of mountings for diverse circuit interrupters are shown in U.S. Pat. Nos. 6,867,679 and 4,123,639.

While the mountings of the prior art may be generally suitable for their intended uses, it would be desirable to provide a retention arrangement for circuit interrupters that is easy to operate and that ensures retention of the circuit interrupter in its mounting especially where the dimensions of the circuit interrupter may vary from the nominal specified dimensions.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
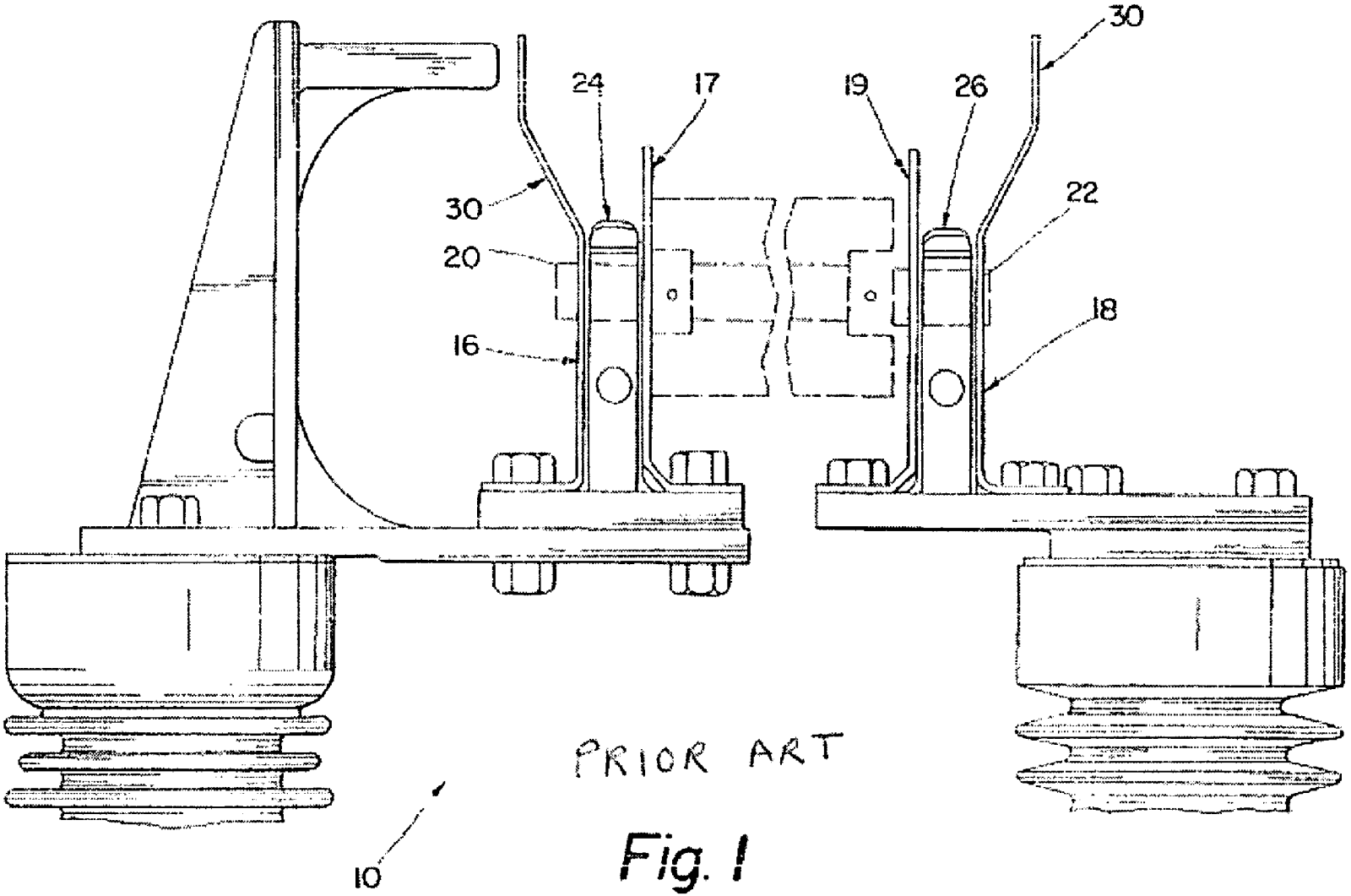
PRIOR ART Fig. 1
FIGS. 1 and 2 are front elevational and top plan views respectively of a prior art mounting for a circuit interrupter.
Figure 2:
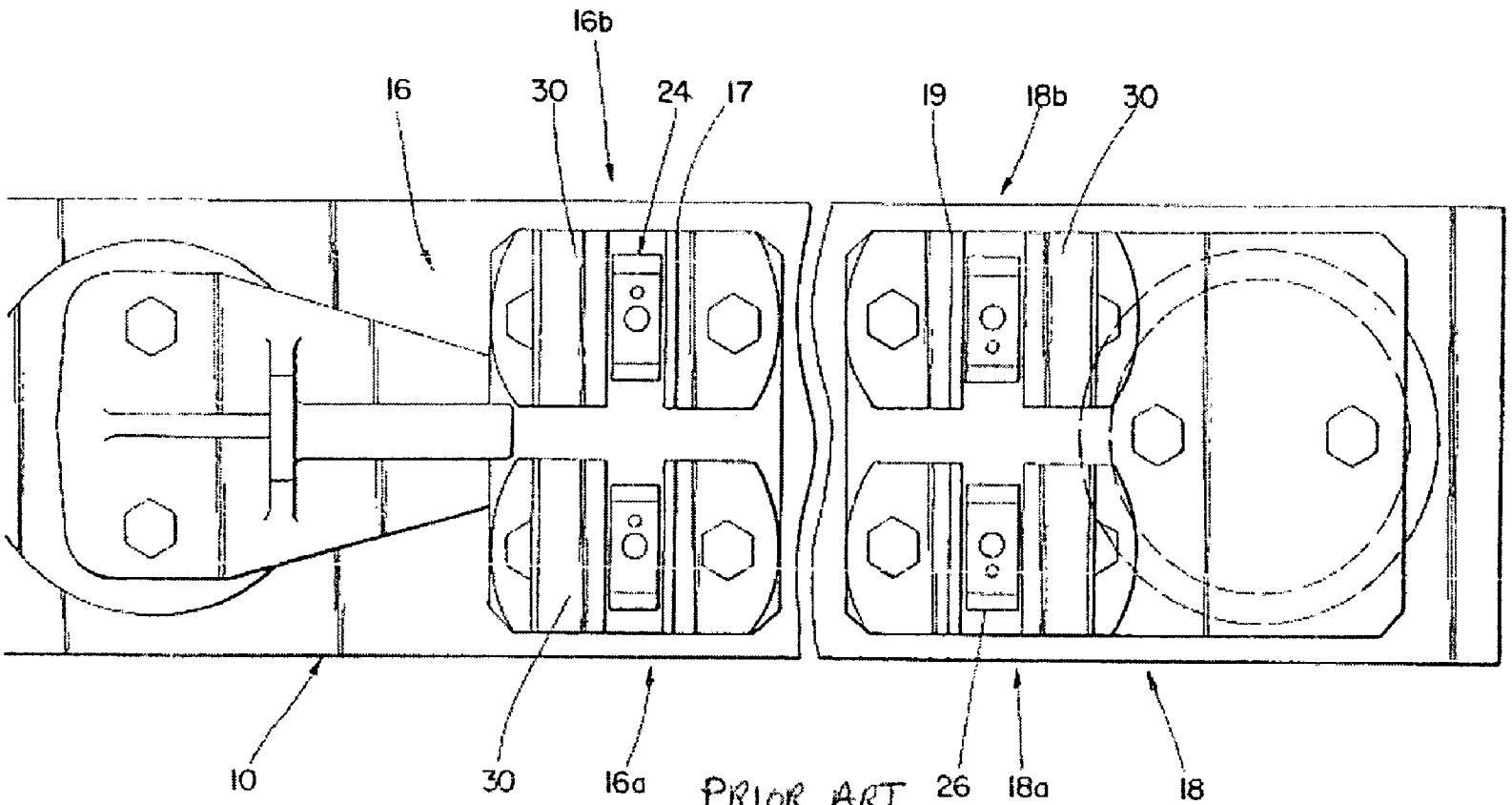
PRIOR ART Fig. 2
Figure 4:
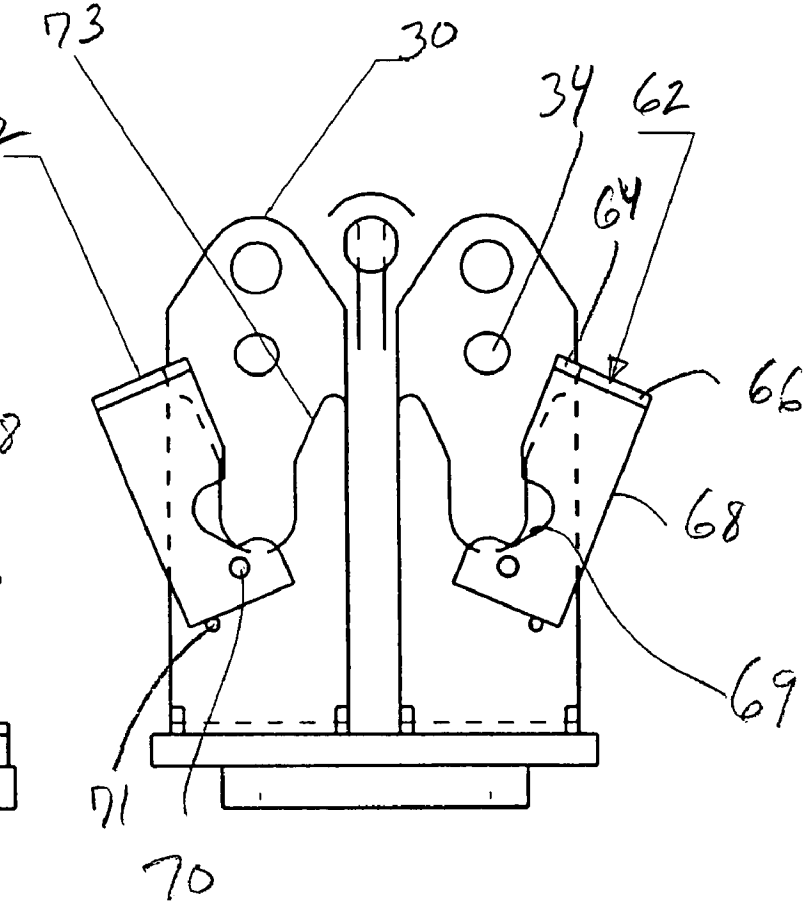
FIGS. 3 and 4 are front elevational and top plan views respectively of an upper portion of a mounting having a retention arrangement according to the present invention and illustrating a position when the circuit interrupter is not installed therein.
Figure 3:
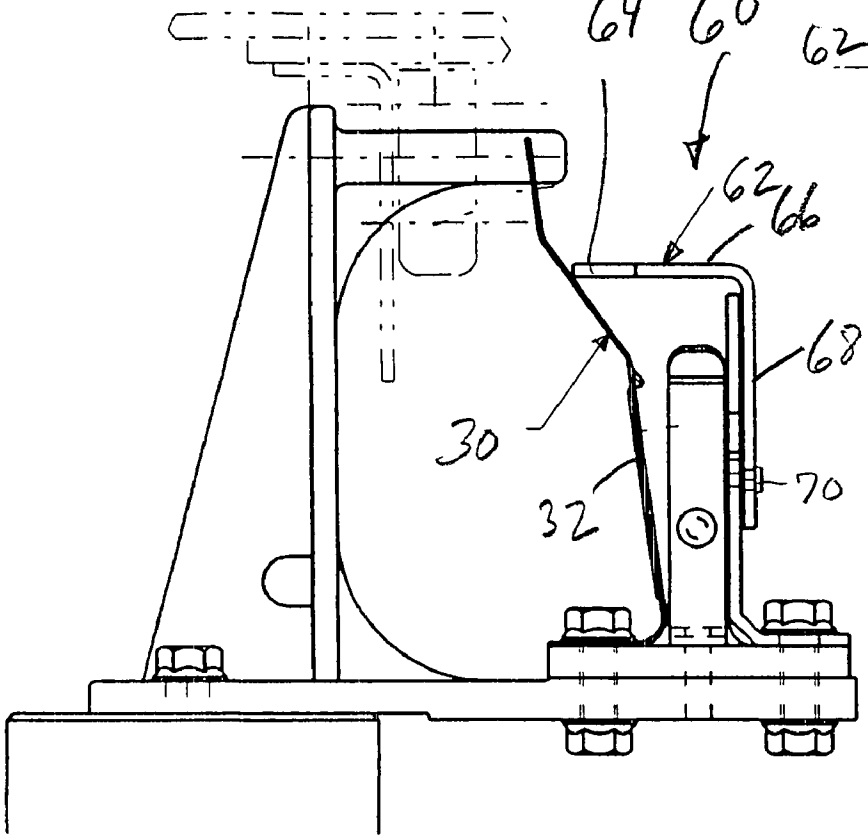
Figure 6:
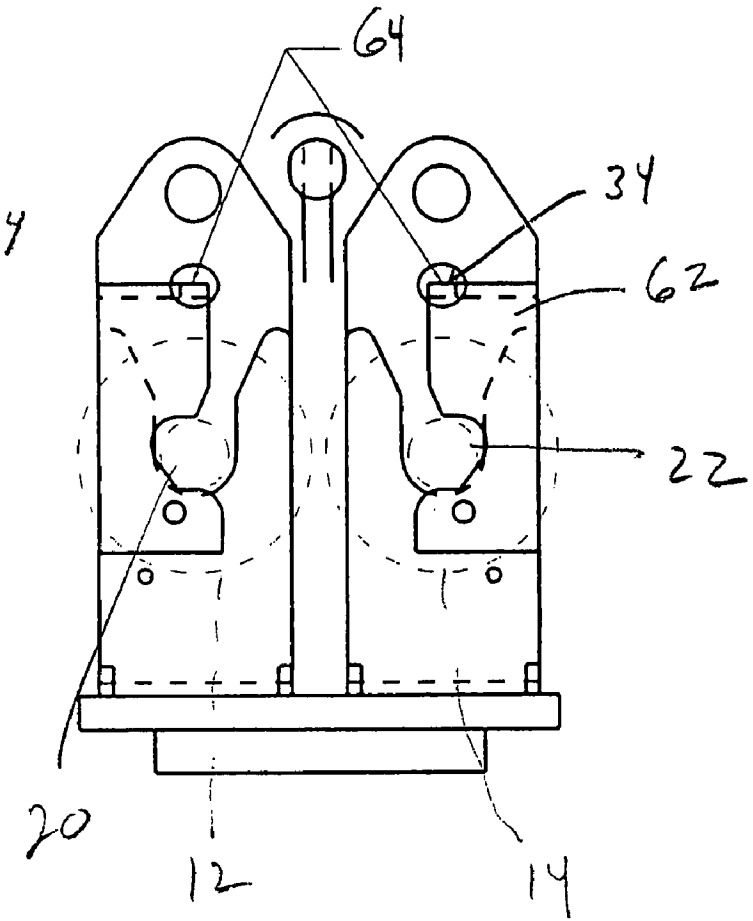
FIGS. 5 and 6 are front elevational and top plan views respectively of an upper portion of a mounting having the retention arrangement according to the present invention and illustrating a position when the circuit interrupter is installed and retained therein.
Figure 5:
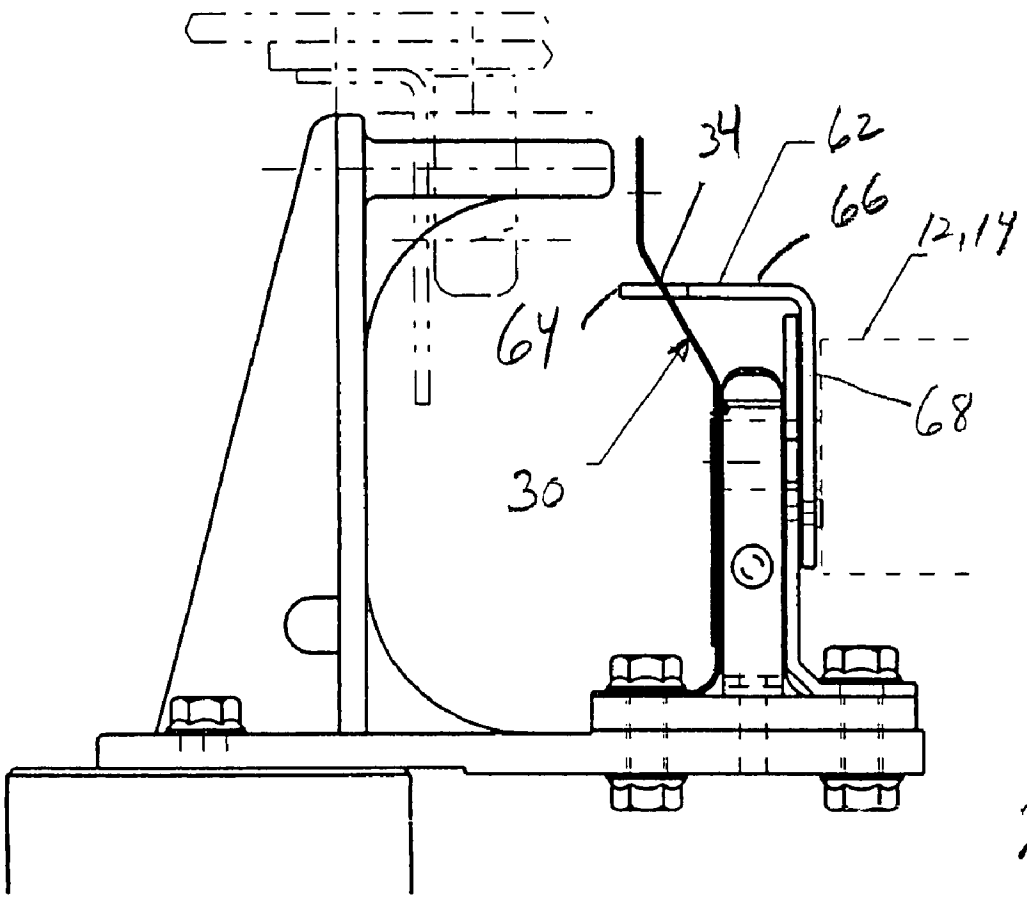

Referring now to FIGS. 1 and 2, a mounting 10 of the type shown in U.S. Pat. No. 6,867,679 is illustrated supporting a circuit interrupter 12, e.g. for use in metal-enclosed gear or the like in the electrical power transmission and distribution field. In the specific illustrative mounting, the mounting 10 also supports a second circuit-interrupter 14 so as to function as a double interrupter mounting. The circuit interrupters 12, 14 are fuses or the like, for example, of the general type shown in U.S. Pat. No. 4,123,639 and available under the tradename NX fuses from Cooper Industries. Of course, it should be understood that the mounting 10 and the retention arrangement of the present invention are suitable for use with other types of circuit-interrupting devices. The mounting 10 includes upper and lower terminal and support arrangements 16, 18 respectively that cooperate with upper and lower device mounting studs 20, 22 respectively of the circuit interrupters 12, 14. The device mounting studs 20, 22 also function as electrical circuit connection points to connect the circuit interrupters 12, 14 in an electrical circuit via respective upper and lower contact assemblies 24, 26 of the mounting 10. The upper and lower contact assemblies include resilient retention facilities for providing suitable electrical contact forces when engaged with the device mounting studs 20, 22.

Thus, the upper and lower terminal and support arrangements 16, 18 retain the circuit interrupters 12, 14 within the mounting 10 and in suitable electrical circuit connection. The upper and lower terminal and support arrangements 16, 18 also preferably include respective guiding arrangements 17, 19 that are bifurcated to receive and guide the device mounting studs 20, 22 during insertion of the circuit interrupters 12, 14.

Each of the upper and lower terminal and support arrangements are selectively operable to release the circuit interrupters 12, 14 for removal from the mounting 10, e.g. upper and lower terminal and support arrangements 16*a*, 18*a* are operable to release the circuit interrupter 12 and upper and lower terminal and support arrangements 16*b*, 18*b* are operable to release the circuit interrupter 14. Accordingly, the circuit interrupters 12, 14 are each individually removable from the mounting 10. In another specific arrangement, the upper terminal and support arrangement 16 is operable to release the circuit interrupters 12, 14 with the lower terminal and support arrangement 18 being of the general type as shown in U.S. Pat. No. 4,123,639.

In a specific application, the circuit interrupters 12, 14 are current-limiting fuses that are rather massive (e.g. 30 pounds or more) and are intended for deenergized circuit manipulation by an operator for removal and replacement. For example, the upper and lower terminal and support arrangements 16, 18 are operable via a hookstick to release the circuit interrupter 12 or 14 and a stick with a clamp attachment is utilized to grasp and remove the circuit interrupter 12 or 14 from the mounting 10. Reference may be made to S&C Electric Company Descriptive Bulletin 851-30 for more information on such handling tools.

With additional reference now to FIGS. 3-6, each of the upper and lower terminal and support arrangements 16*a*, 16*b*, 18*a* and 18*b* include a latch arm 30 that is moved to release the respective device mounting stud 20, 22 from a retained holding position to a latch released position. In a specific embodiment, the latch arms 30 include holes 32 formed therethrough for passage of the device mounting studs 20, 22 and engagement and retention thereof by the latch arms 30. Thus, the latch arms 30 retain the circuit interrupters 12, 14 in the mounting 10 until operated by manipulation away from the device mounting studs 20, 22 so as to release the device mounting studs 20, 22 from engagement within the holes 32.

In accordance with important aspects of the present invention, a retention arrangement 60 is provided to ensure the retention of the circuit interrupters 12, 14 in the mounting 10. Specifically, the retention arrangement 60 includes an actuating arm 62 that holds the latch arm 30 in an open position in FIGS. 3 and 4 with the circuit interrupters 12, 14 removed from the mounting 10. With additional reference now to FIGS. 5 and 6, when the circuit interrupters 12, 14 are installed into the mounting 10, the device mounting studs 20, 22 engage and move the actuating arm 62 via guiding surfaces 69 formed in the arms 62. As the arm 62 moves, an extending tab 64 of the arm 62 enters a hole 34 in the latch arm 30 permitting the latch 30 to move toward a closed, latched position. In this position, the circuit interrupters 12, 14 are retained securely due to the interference of the latch 30 and the arm 62. The arm 62 includes an extending portion 66 that carries the tab 64 and a mounting portion 68 that extends at an approximate right angle to the portion 66. The mounting portion 68 is pivotally mounted with respect to the mounting 10 at pivot point 70. In a specific implementation, stop pins 71 are provided to define the open, released position of the arms 62. Also, in a specific implementation, the mounting 10 includes guiding brackets 73 to assist in the insertion of the mounting studs 20, 22 and relative positioning with respect to the arms 62.

Figure 7:
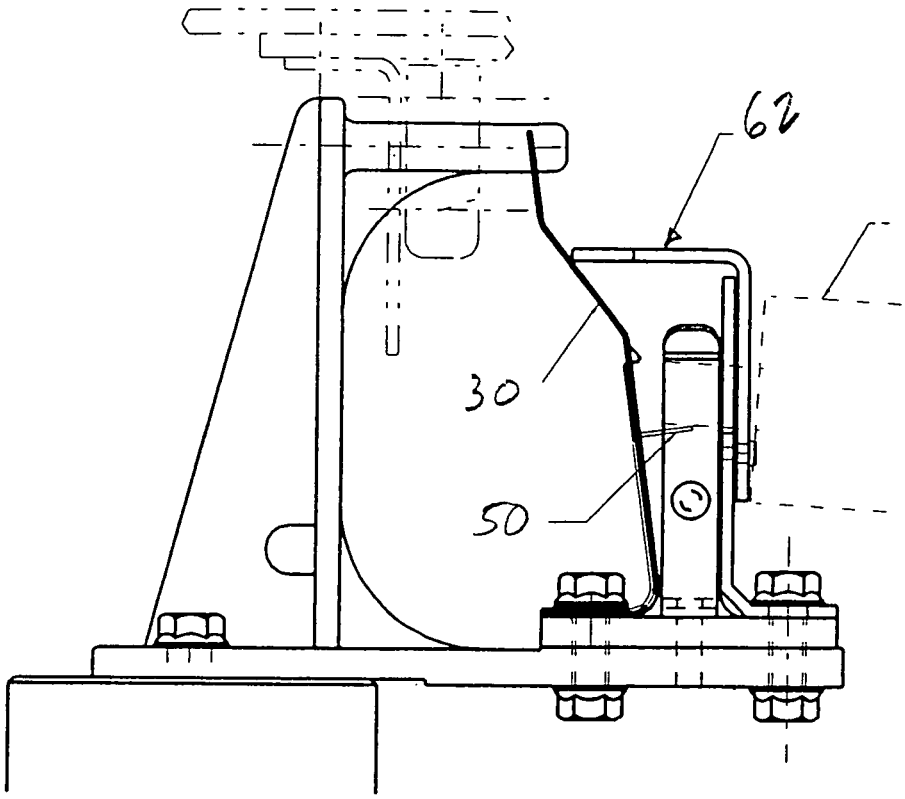
FIG. 7 is front elevational view of the mounting of FIGS. 3-6 illustrating an operative position when a circuit interrupter is being removed from the mounting.

With reference now to FIG. 7, to remove the circuit interrupters, the latch 30 is moved outward with a handling tool. A resilient guiding member 50 which may also be characterized as a kick-out spring and as shown in U.S. Pat. No. 6,867,679, the device mounting studs 20, 22 are moved out of the position in FIGS. 5 and 6. The movement of the studs 20, 22 also causes movement of the arm 62 to the open, released position.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

The invention claimed is:

1. A retention arrangement for a mounting for a circuit interrupter having spaced apart first and second contacts, the mounting having a pair of fixedly mounted contacts having resilient characteristics providing contact force when the first and second contacts of the circuit interrupter are engaged with the mounting, at least one latch at one of the fixedly mounted contacts that is engageable for movement from a holding position to a latch release position to release a latch holding force on one of the contacts of the circuit interrupter, the retention arrangement comprising an actuating arm that maintains the at least one latch in the latch release position and that is contacted by a first portion of the circuit interrupter upon installation thereof so as to release the at least one latch to move from the latch release position to the holding position, the actuating arm including an extending member that engages a cooperating portion of the at least one latch to hold the at least one latch in the holding position until the at least one latch is moved out of the holding position by manipulation thereof.

2. A retention arrangement for a mounting for a circuit interrupter having spaced apart first and second contacts, the mounting having a pair of fixedly mounted contacts having resilient characteristics providing contact force when the first and second contacts of the circuit interrupter are engaged with the mounting, at least one latch at one of the fixedly mounted contacts that is engageable for movement from a holding position to a latch release position to release a latch holding force on one of the contacts of the circuit interrupter, the retention arrangement comprising first means carried by the at least one latch and second means interacting with the first means and the latch to hold the at least one latch in the released position and being acted upon by the circuit interrupter when being installed to permit the at least one latch to move to the holding position and retaining the at least one latch in the holding position.

3. The retention arrangement of claim 2 wherein the mounting further includes facilities for resiliently biasing the latch toward the released position, the at least one latch being manipulated out of the holding position to remove the circuit interrupter from the mounting, the second means comprising an actuating arm, the actuating arm being moved to an open, released position when the at least one latch is moved out of the released position.

4. The retention arrangement of claim 3 wherein the actuating arm includes a protruding member that engages the at least one latch in the holding position of the at least one latch.

5. The retention arrangement of claim 4 wherein the circuit interrupter includes at least one protruding stud, the actuating arm being acted upon by the at least one protruding stud.

* * * * *